US008289119B2

(12) United States Patent
Lin et al.

(10) Patent No.: US 8,289,119 B2
(45) Date of Patent: Oct. 16, 2012

(54) CONDUCTIVE WINDING MODULE AND MAGNETIC ELEMENT HAVING SUCH CONDUCTIVE WINDING MODULE

(75) Inventors: Tsai-Sheng Lin, Taoyuan Hsien (TW); Yu-Chin Lin, Taoyuan Hsien (TW); Zhi-Liang Zhang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 12 days.

(21) Appl. No.: 12/491,060

(22) Filed: Jun. 24, 2009

(65) Prior Publication Data

US 2010/0026437 A1 Feb. 4, 2010

(30) Foreign Application Priority Data

Aug. 4, 2008 (TW) ..... 97129573 A

(51) Int. Cl.
*H01F 27/29* (2006.01)
*H01F 27/28* (2006.01)
*H01F 27/30* (2006.01)

(52) U.S. Cl. ..... 336/192; 336/195; 336/206

(58) Field of Classification Search ..... 336/138, 336/170, 173, 172, 192, 195, 206, 223, 225, 336/188, 180
See application file for complete search history.

(56) References Cited

U.S. PATENT DOCUMENTS

| | | | | |
|---|---|---|---|---|
| 6,087,922 | A * | 7/2000 | Smith | 336/223 |
| 6,222,437 | B1 * | 4/2001 | Soto et al. | 336/200 |
| 2003/0052767 | A1 * | 3/2003 | Yamanobe et al. | 336/232 |
| 2007/0176722 | A1 * | 8/2007 | Podlisk et al. | 336/200 |
| 2008/0122569 | A1 * | 5/2008 | Ye et al. | 336/223 |

* cited by examiner

*Primary Examiner* — Mohamad Musleh
*Assistant Examiner* — Ronald Hinson

(57) ABSTRACT

A conductive winding module is used in a magnetic element. The conductive winding module includes multiple conductive units and multiple output terminals. The conductive units have respective hollow portions. The output terminals are arranged on the conductive units. The conductive units are folded with respect to a connecting line between the conductive units such that the hollow portions are aligned with each other to define a through-hole and the multiple output terminals are staggered to form at least three output terminals to be inserted into a circuit board.

20 Claims, 9 Drawing Sheets

CONDUCTIVE WINDING MODULE AND MAGNETIC ELEMENT HAVING SUCH CONDUCTIVE WINDING MODULE

PRIORITY CLAIM

This application claims priority to Taiwanese Patent Application No. 097129573 filed on Aug. 4, 2008.

FIELD OF THE INVENTION

The present invention relates to a conductive winding module, and more particularly to a slim-type conductive winding module. The present invention also relates to a magnetic element having such a conductive winding module.

BACKGROUND OF THE INVENTION

Nowadays, magnetic elements such as inductors and transformers are widely used in many electronic devices to generate induced magnetic fluxes. Recently, since the electronic devices are developed toward minimization, the electronic components contained in the electronic products become small in size and light in weight. Therefore, the magnetic element and its conductive winding module are slim.

Take a transformer for example. In the transformer, a primary winding coil and a secondary winding coil are wound around a bobbin. Since the bobbin should have a winding section for winding the primary winding coil and the secondary winding coil, the volume of the bobbin is very bulky. In addition, since each winding coil has only two terminals, the conductive winding module formed by winding the coil also has two terminals and the applications thereof are limited.

Referring to FIG. 1, a schematic exploded view of a conventional transformer disclosed in for example U.S. Pat. No. 7,091,817 is illustrated. The transformer 1 of FIG. 1 principally includes a winding frame member 10, a primary winding coil (not shown), multiple conductive pieces 12 and a magnetic core assembly 13. The winding frame member 10 includes a tube structure 101, a first partition plate 102 and a second partition plate 103. The first partition plate 102 is parallel with second partition plate 103. A winding section 104 is defined between the first partition plate 102, the second partition plate 103 and the external surface of the tube structure 101. In addition, bending pieces 105 and 106 are extended from both edges of the first partition plate 102 and the second partition plate 103, respectively. Accordingly, two guiding slots 107 are formed on opposite sides of the winding frame member 10 for accommodating corresponding conductive pieces 12 therein. The magnetic core assembly 13 includes a first magnetic part 131 and a second magnetic part 132. Each conductive piece 12 is a U-shaped copper piece and includes a hollow portion 121 facing the winding member 121. After the conductive pieces 12 are received in the guiding slots 107 and fixed onto the winding frame member 10, the conductive pieces 12 are electrically connected to a system circuit board (not shown).

The conductive piece 12 of the transformer 1 is a one-loop structure in replace of the secondary winding coil. Although the one-loop conductive piece 12 may reduce the overall volume of the transformer 1, there are still some drawbacks. For example, as the number of the conductive pieces 12 is increased, corresponding guiding slots 107 are required and thus the overall volume of the transformer is increased. In addition, since each conductive piece 12 has only two terminals, the conductive winding module using the conductive piece 12 has also two output terminal and the applications of the conductive winding module are limited. For increasing the output terminals of the conductive winding module, the output terminals need to be welded together and thus the fabricating process of the transformer is troublesome and complicated. In other words, the conventional conductive winding module is difficult to comply with both requirements of reduced volume and increased conductivity.

Therefore, there is a need of providing an improved conductive winding module so as to obviate the drawbacks encountered from the prior art.

SUMMARY OF THE INVENTION

An object of the present invention provides a conductive winding module by continuously winding multiple loops of coils so as to reduce the overall volume.

Another object of the present invention provides a conductive winding module that is easily assembled and has a simplified configuration.

Another object of the present invention provides a conductive winding module having at least three output terminals so as to expand the applications.

A further object of the present invention provides a magnetic element having such a conductive winding module so that the magnetic element is suitable for mass production.

In accordance with an aspect of the present invention, there is provided a conductive winding module for use in a magnetic element. The conductive winding module includes multiple conductive units and multiple output terminals. The conductive units have respective hollow portions. The output terminals are arranged on the conductive units. The conductive units are folded with respect to a connecting line between the conductive units such that the hollow portions are aligned with each other to define a through-hole and the multiple output terminals are staggered to form at least three output terminals to be inserted into a circuit board.

In accordance with another aspect of the present invention, there is provided a magnetic element. The magnetic element includes a conductive winding module and a magnetic core assembly. The conductive winding module includes multiple conductive units and multiple output terminals. The conductive units have respective hollow portions. The output terminals are arranged on the conductive units. The conductive units are folded with respect to a connecting line between the conductive units such that the hollow portions are aligned with each other to define a through-hole and the multiple output terminals are staggered to form at least three output terminals to be inserted into a circuit board. The magnetic core assembly is partially embedded into said through-hole of the conductive winding module.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
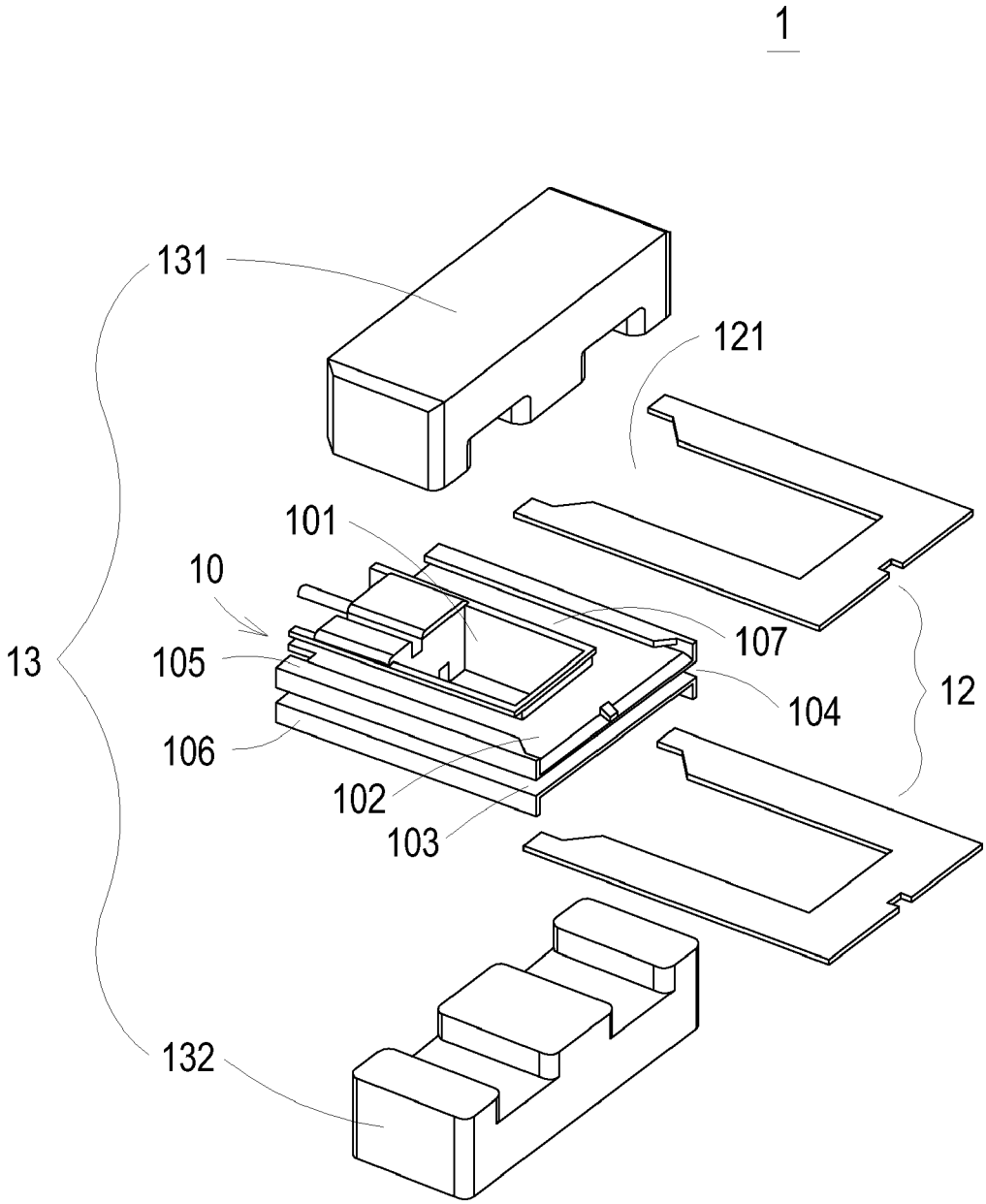
FIG.1 PRIOR ART
FIG. 1 is a schematic exploded view of a conventional transformer.
Figure 2B:
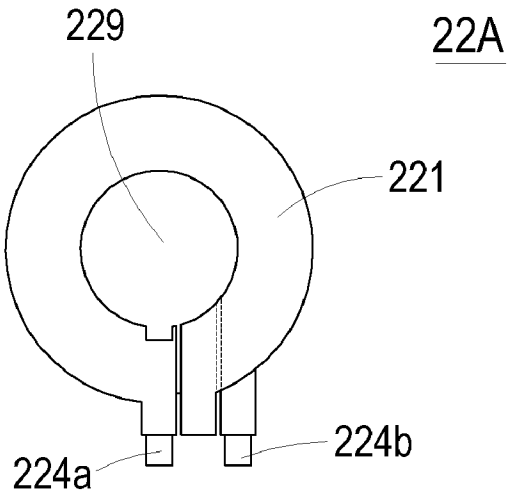
FIG. 2B is a schematic perspective view of the folded first conductive unit of FIG. 2A.
Figure 2A:
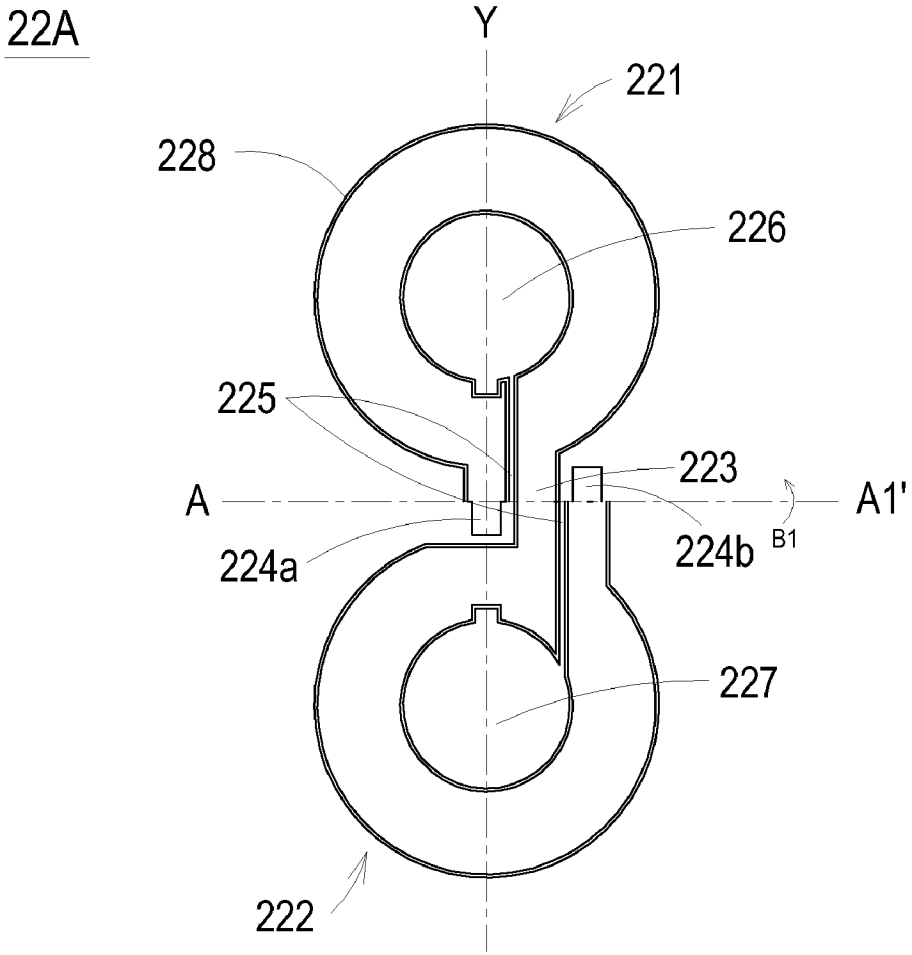
FIG. 2A is a schematic view illustrating a first conductive unit used in a conductive winding module of the present invention.

FIG. 2A is a schematic view illustrating a first conductive unit used in a conductive winding module of the present invention. The first conductive unit 22A is a single conductive piece made of metallic material such as copper. The first conductive unit 22A comprises a first segment 221 and a second segment 222. The first segment 221 and the second segment 222 are collectively connected to a connecting line 223. In this embodiment, each of the first segment 221 and the second segment 222 is ring-shaped and has a notch 225 in the vicinity of the connecting line 223. The first segment 221 and the second segment 222 have a first hollow portion 226 and a second hollow portion 227, respectively. The output terminals 224*a* and 224*b* are integrally formed on the first segment 221 and the second segment 222, respectively. The first segment 221 and the second segment 222 have substantially the same profiles. The first output terminal 224*a* and the second output terminal 224*b* are connected to the first segment 221 and the second segment 222, respectively. The first output terminal 224*a* is disposed along the line passing through the common centerline Y of the first hollow portion 226 and a second hollow portion 227. The second output terminal 224*b* is opposed to the first output terminal 224*a* with respect to the connecting line 223. The first conductive unit 22A further includes an insulating layer 228 that is sheathed around the first segment 221 and the second segment 222. The output terminals 224*a* and 224*b* are not sheathed by the insulating layer 228.

The second segment 222 is folded toward the first segment 221 in the direction B1 with respect to the folding line A1A1' such that the second segment 222 is in contact with or adjacent to the first segment 221. After the folding process, the first hollow portion 226 and the second hollow portion 227 are aligned with each other to form a through-hole 229, and the output terminals 224*a* and 224*b* are extended to the same direction. Meanwhile, the first conductive unit 22A, which is an unbroken two-loop conductive piece, is produced. The resulting structure of the folded first conductive unit 22A is schematically shown in FIG. 2B. It is noted that, however, those skilled in the art will readily observe that numerous modifications and alterations may be made while retaining the teachings of the invention. For example, the first conductive unit may be an unbroken conductive piece having more than three loops. In addition, the first conductive unit may have arbitrary shape such as a rectangular shape.

Figure 2D:
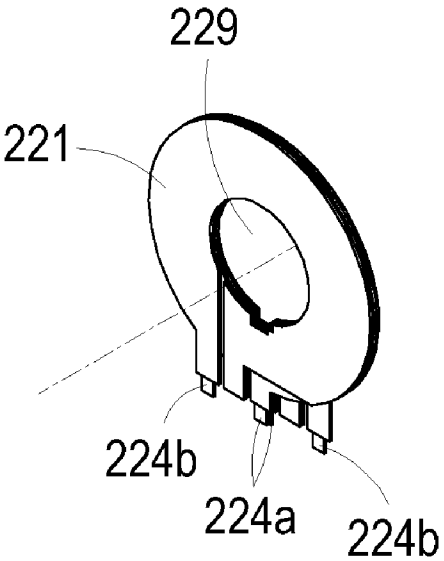
FIG. 2D is a schematic assembled view illustrating the conductive winding module of FIG. 2C.
Figure 2C:
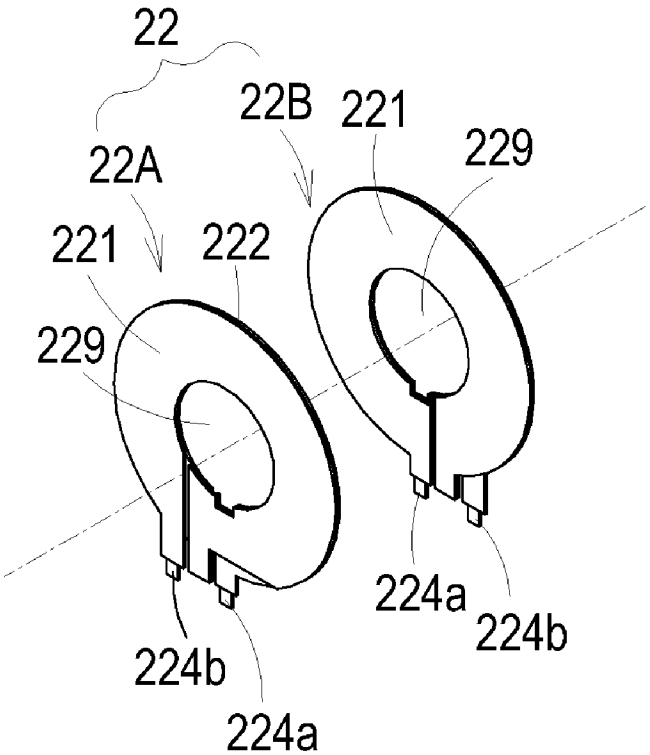
FIG. 2C is a schematic exploded illustrating a conductive winding module according to a first preferred embodiment of the present invention.

FIGS. 2C and 2D are respectively schematic exploded and assembled views of a conductive winding module according to a first preferred embodiment of the present invention. As shown in FIGS. 2C and 2D, the conductive winding module 22 principally includes the first conductive unit 22A, a second conductive unit 22B and multiple output terminals 224*a* and 224*b*. The configurations of the second conductive unit 22B are identical to those of the first conductive unit 22A, and are not redundantly described herein. For assembling the first conductive unit 22A with the second conductive unit 22B, the second conductive unit 22B should be turned over such that the through-holes 229 of the first conductive unit 22A and the second conductive unit 22B are aligned with each other. In addition, the first output terminal 224*a* of the first conductive unit 22A and the first output terminal 224*a* of the second conductive unit 22B are overlapped with each other. In the combined structure of the first conductive unit 22A and the second conductive unit 22B, the second output terminal 224*b* of the first conductive unit 22A and the second output terminal 224*b* of the second conductive unit 22B are disposed on bilateral sides of the overlapped first output terminals 224*a*. As a consequence, the conductive winding module 22 is deemed to have three output terminals (224*b*, 224*a* and 224*b*) in a staggered arrangement.

For facilitating securely combining the first conductive unit 22A with the second conductive unit 22B, the contact areas of the first conductive unit 22A and the second conductive unit 22B are bonded together via an adhesive (not shown).

Figure 3A:
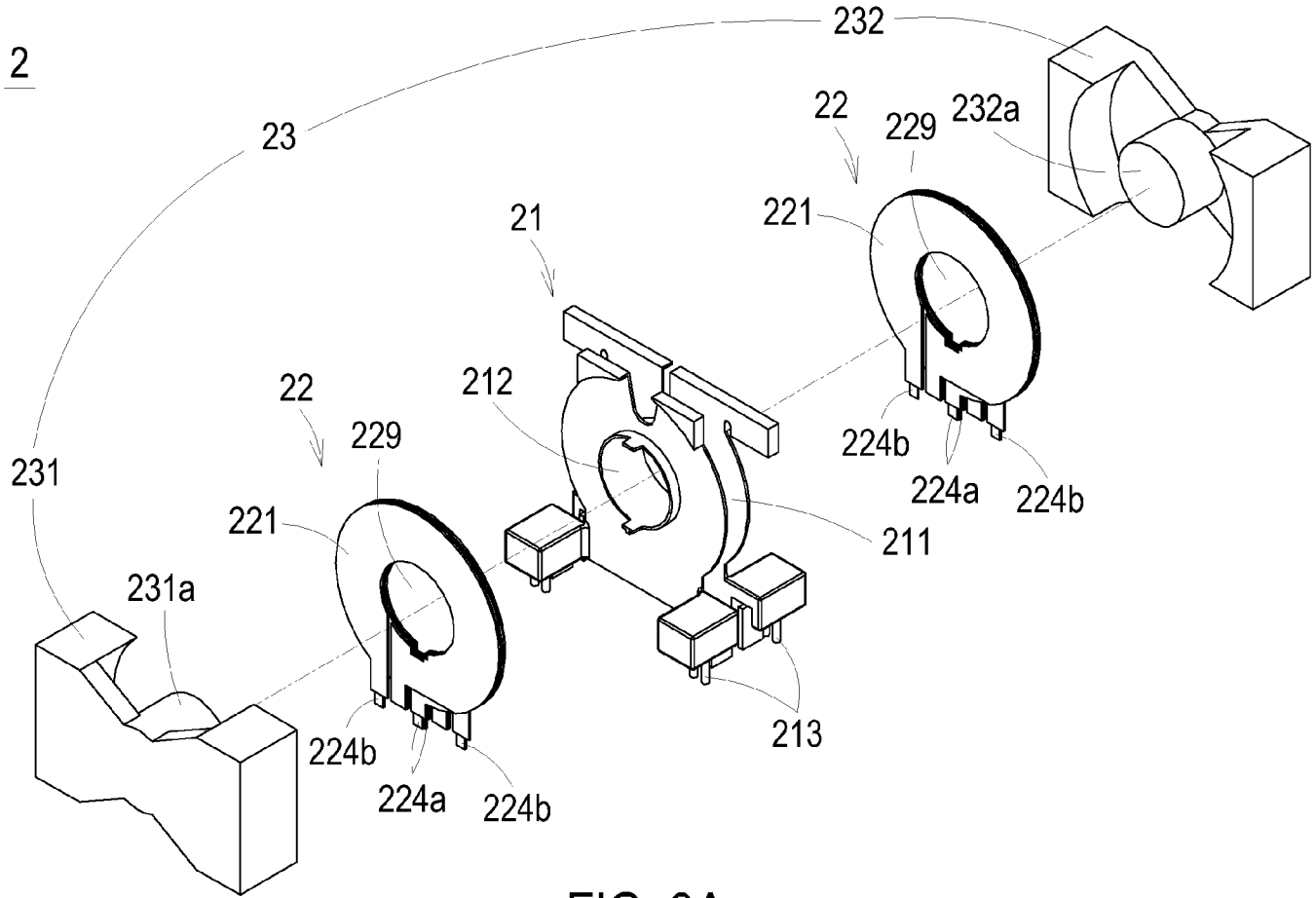
FIG. 3A is a schematic exploded view illustrating a transformer having a conductive winding module of FIG. 2D.
Figure 3B:
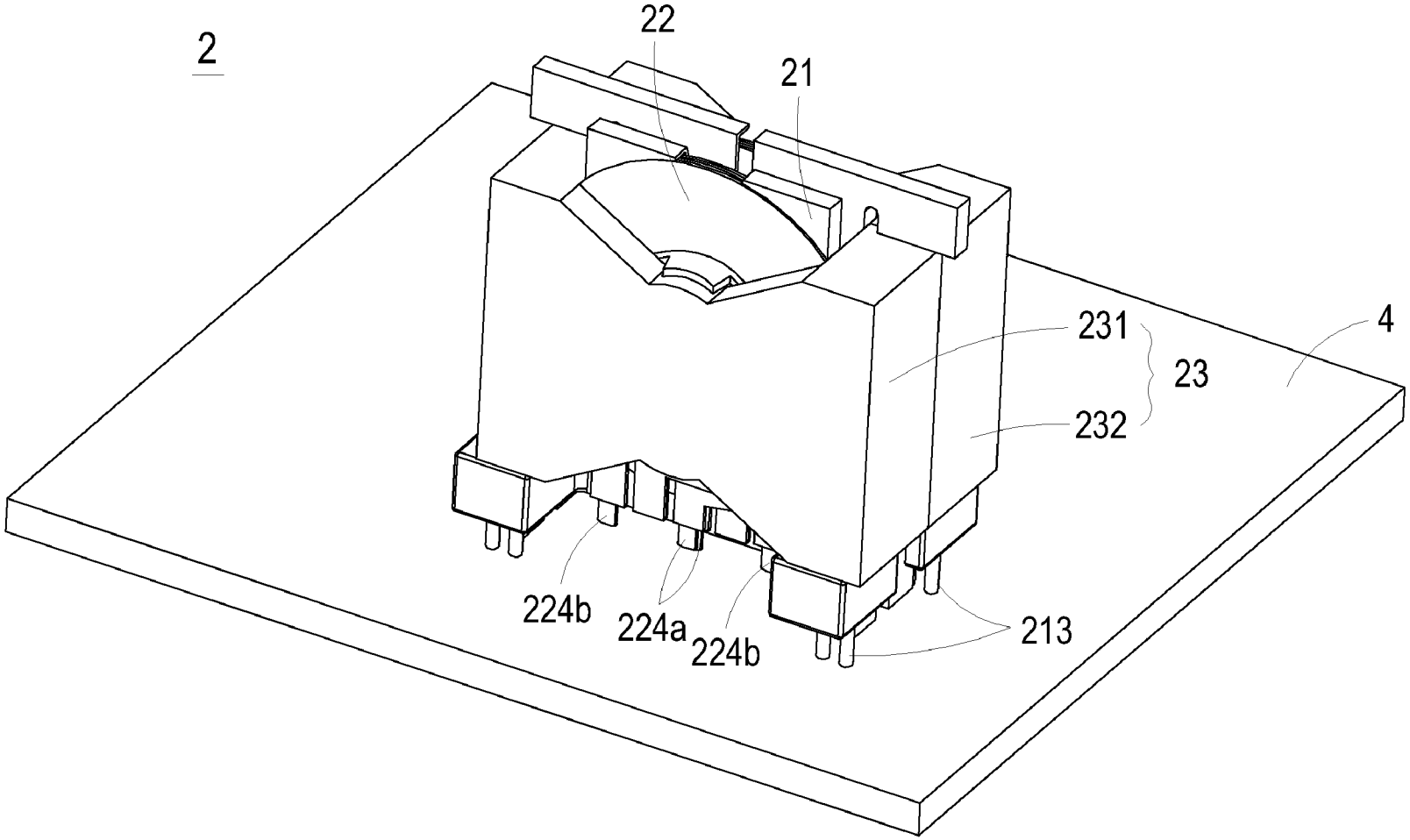
FIG. 3B is a schematic perspective view illustrating that the transformer of FIG. 3A is mounted on a system circuit board.

FIG. 3A is a schematic exploded view illustrating a transformer having a conductive winding module of FIG. 2D. FIG. 3B is a schematic perspective view illustrating that the transformer of FIG. 3A is mounted on a circuit board. As shown in FIGS. 3A and 3B, the transformer 2 principally includes a primary winding assembly, multiple conductive winding modules 22 and a magnetic core assembly 23. In this embodiment, the conductive winding module 22 functions as a secondary winding assembly. The primary winding assembly includes a bobbin 21 and a primary winding coil (not shown). The bobbin 21 includes a winding section 211 and a channel 212. The primary winding coil is wound around the winding section 211. In addition, the bobbin 21 has several pins 213 extended from the bottom surface thereof. By soldering the pins 213 on a circuit board 4 (as shown in FIG. 3B), the transformer 2 is mounted on and electrically connected to the circuit board 4. The magnetic core assembly 23 includes a first magnetic part 231 and a second magnetic part 232. In this embodiment, the first magnetic part 231 and the second magnetic part 232 of the magnetic core assembly 23 are cooperatively formed as an EE-type core assembly. The first magnetic part 231 and the second magnetic part 232 have respective middle portions 231*a* and 232*a*.

It is noted that, however, those skilled in the art will readily observe that numerous modifications and alterations may be made while retaining the teachings of the invention. For example, the primary winding assembly may be replaced by a specified circuit board. Such a specified circuit board is substantially a ring-shaped structure and the primary winding coil is formed as a trace pattern within the circuit board.

Hereinafter, a process of assembling the transformer 2 will be illustrated with reference to FIG. 3A. First of all, two conductive winding modules 22 are arranged on bilateral sides of the bobbin 21 such that the through-holes 229 of the conductive winding modules 22 are aligned with the channel 212 of the bobbin 21. Next, the middle portions 231*a*, 232*a* of the first magnetic part 231 and the second magnetic part 232 are partially embedded into the through-holes 229 of the conductive winding modules 22 and the channel 212 of the bobbin 21. As a result, the primary winding assembly and the secondary winding assemblies (i.e. the conductive winding modules 22) interact with the magnetic core assembly 23 to achieve the purpose of voltage regulation. The resulting structure of the transformer is schematically shown in FIG. 3B. In this embodiment, each of the conductive winding modules 22 is an unbroken multi-loop conductive piece that has three output terminals (224*b*, 224*a* and 224*b*) in a staggered arrangement. Furthermore, the circuit board 4 as shown in FIG. 3B is an auxiliary circuit board or a system circuit board.

For facilitating securely assembling the transformer 2, the inner surfaces of the first magnetic part 231 and the second magnetic part 232 are bonded onto the conductive winding modules 22 via an adhesive (not shown).

In some embodiments, several conductive winding modules 22 and the magnetic core assembly 23 are directly combined as an inductor. The procedures of assembling the inductor are similar to those described in FIG. 3A, and are not redundantly described herein. As a result, the conductive winding modules 22 interact with the magnetic core assembly 23 to achieve the purpose of voltage regulation.

Figure 4A:
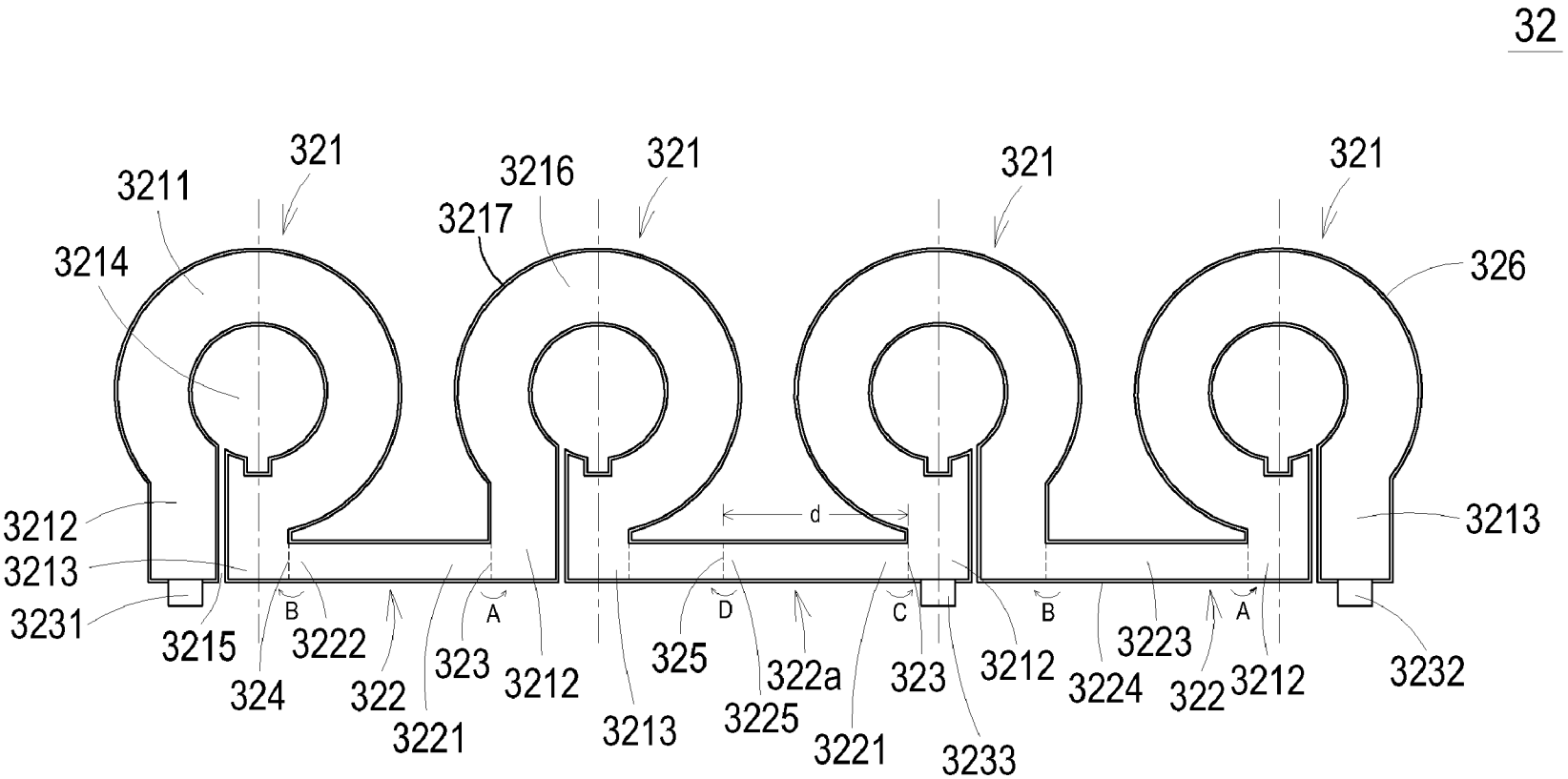
FIG. 4A is a schematic view illustrating a conductive winding module according to a second preferred embodiment of the present invention.

FIG. 4A is a schematic view illustrating a conductive winding module according to a second preferred embodiment of the present invention. The conductive winding module 32 is a single conductive piece made of metallic material such as copper. The conductive winding module 32 principally includes multiple conductive units 321, multiple connecting parts 322 and multiple output pins. In this embodiment, four conductive units 321 including first, second, third and fourth conductive unit are included in the conductive winding module 32 for illustration. Every two adjacent conductive units 321 are interconnected by a connecting part 322.

Every conductive unit 321 principally comprises a conductive body 3211, a first end 3212, a second end 3213, a first surface 3216 and a second surface 3217. In this embodiment, the conductive body 3211 is ring-shaped and has a notch 3215 between the first end 3212 and the second end 3213. In addition, a hollow portion 3214 is formed in the center of the conductive body 3211. For each conductive unit 321, second surface 3217 is opposed to the first surface 3216. The first surfaces 3216 of all conductive units 321 face toward the same direction. The second surfaces 3217 of all conductive units 321 face toward the same direction. For example, the first surfaces 3216 of these conductive units 321 face upwardly but the second surfaces 3217 thereof face downwardly.

Every connecting part 322 has a first edge 3221 and a second edge 3222. A first connecting line 323 is defined between the first edge 3221 of the connecting part 322 and the first end 3212 of the adjacent conductive unit 321. A second connecting line 3324 is defined between the second edge 3222 of the connecting part 322 and the second end 3213 of the adjacent conductive unit 321. Every connecting part 322 has a first surface 3223 and a second surface 3224, which are opposed to each other. The first surfaces 3223 and the second surfaces 3224 are coplanar with the first surfaces 3216 and the second surfaces 3217 of the conductive units 321, respectively.

Moreover, a first output terminal 3231 is downwardly extended from the first end 3212 of the first conductive unit 321 and a second output terminal 3232 is downwardly extended from the second end 3213 of the fourth conductive unit 321. In addition, a third output terminal 3233 is downwardly extended from the first end 3212 or the second end 3213 of the second or third conductive unit 321 along the line passing through the centerline of the hollow portion 3214. The conductive winding module 32 further includes an insulating layer 326 that is sheathed around the conductive units 321 and the connecting parts 322. The output terminals 3231, 3232 and 3233 are not sheathed by the insulating layer 326.

Figure 4B:
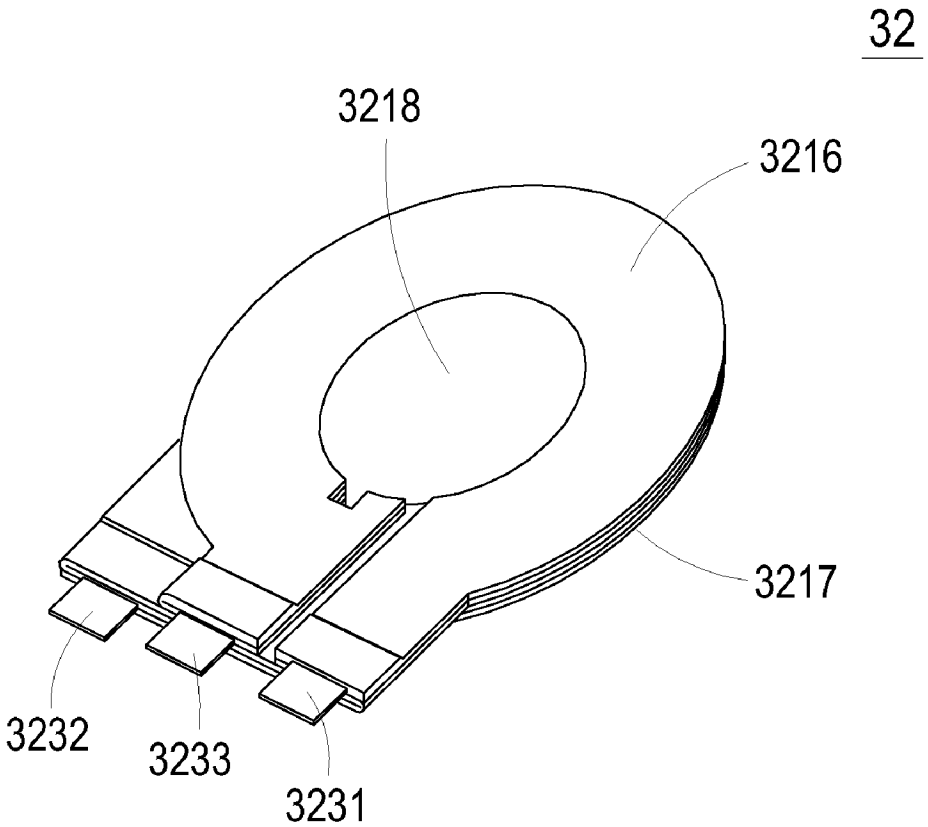
FIG. 4B is a schematic perspective view of the folded conductive winding module of FIG. 4A.

FIG. 4B is a schematic perspective view of the folded conductive winding module of FIG. 4A. Please refer to FIGS. 4A and 4B. By using the first connecting line 323 and the second connecting line 324 as bending lines, the first edges 3221 of the connecting parts 322 are bent in the direction A such that the second surfaces 3224 of the connecting parts 322 are close to the second surfaces 3217 of the conductive units 321. In addition, the second edges 3222 of the connecting parts 322 are bent in the direction B such that the first surfaces 3223 of the connecting parts 322 are close to the first surfaces 3216 of the conductive units 321. In this embodiment, since the centerline of the hollow portion 3214 of the second conductive unit 321 passes through the second end 3213 thereof and the centerline of the hollow portion 3214 of the third conductive unit 321 passes through the first end 3212 thereof, the connecting part 322*a* between the second and third conductive units 321 is longer than other connecting part 322. The connecting part 322*a* between the second and third conductive units 321 has a bending line 325. The distance d between the bending line 325 and the first connecting line 323 of the third conductive unit 321 is substantially equal to the length of any other connecting part 322. By using the first connecting line 323 and the bending line 325 as bending lines, the first edges 3221 of the connecting part 322*a* are bent in the direction C such that the second surface 3224 of the connecting part 322*a* is close to the second surface 3217 of the third conductive unit 321. In addition, the edge 3225 of the connecting part 322*a* are bent in the direction D such that the first surface 3223 of the connecting part 322*a* is close to the first surface 3216 of the second conductive unit 321. The resulting structure of the folded conductive winding module is schematically shown in FIG. 4B. After the folding process, the hollow portions 3214 of these conductive units 321 are aligned with each other to define a through-hole 3218.

Please refer to FIG. 4 again. In this embodiment, the conductive winding module 32 is an unbroken four-loop conductive piece that has three output terminals (3231, 3232 and 3233) in a staggered arrangement. Furthermore, the circuit board 4 as shown in FIG. 3B is an auxiliary circuit board or a system circuit board. It is noted that, however, those skilled in the art will readily observe that numerous modifications and alterations may be made while retaining the teachings of the invention. For example, the conductive winding module of the present invention may have more conductive units 321 and more connecting parts 322 so as to form an unbroken conductive piece having more than four loops. Since the conductive winding module is an unbroken multi-loop conductive piece, the overall volume of the conductive winding module is reduced. In addition, the conductive body of the conductive part of the conductive winding module may have an arbitrary shape such as a rectangular shape or a polygonal shape.

Figure 5A:
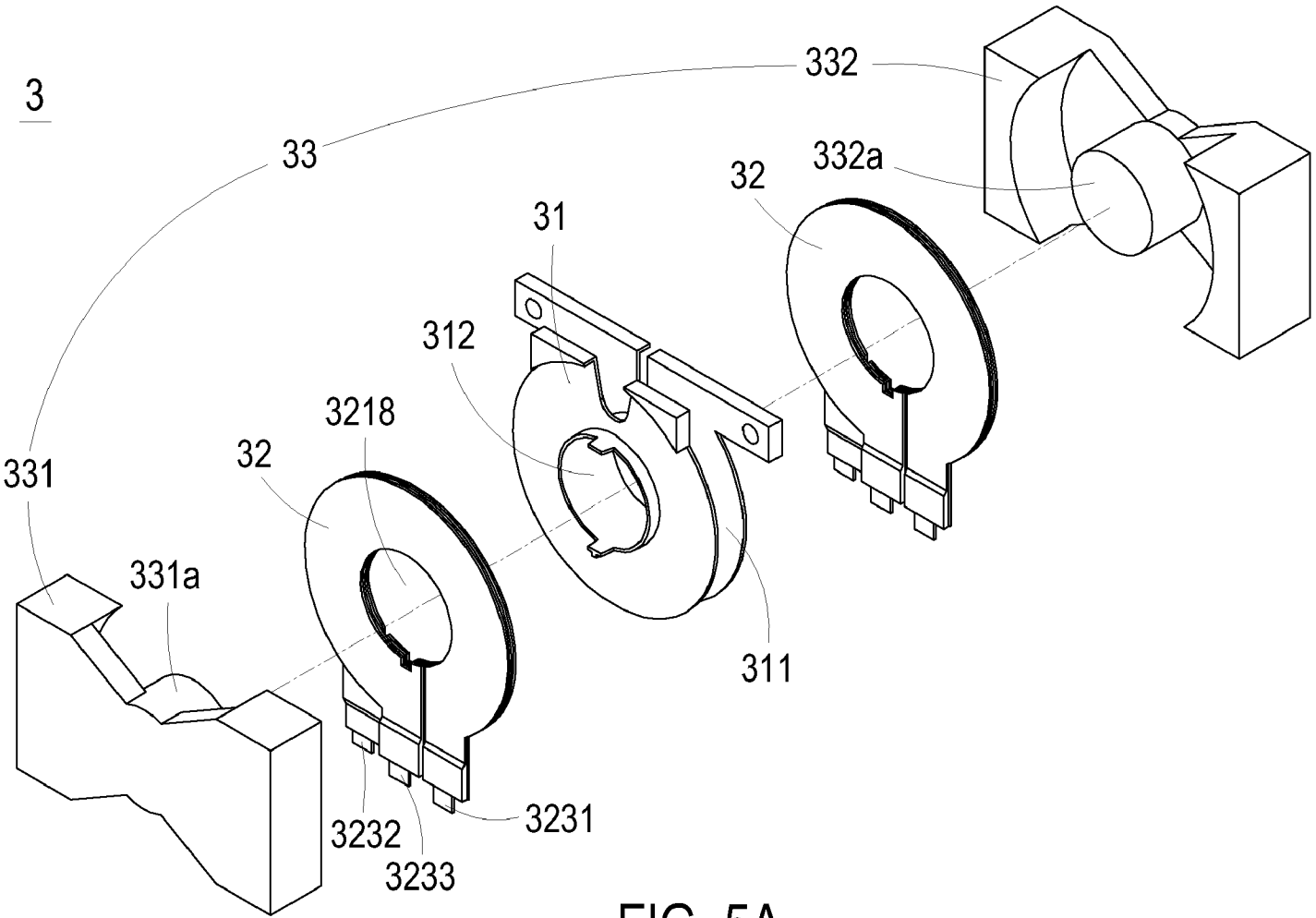
FIG. 5A is a schematic exploded view illustrating a transformer having a conductive winding module of FIG. 4B.
Figure 5B:
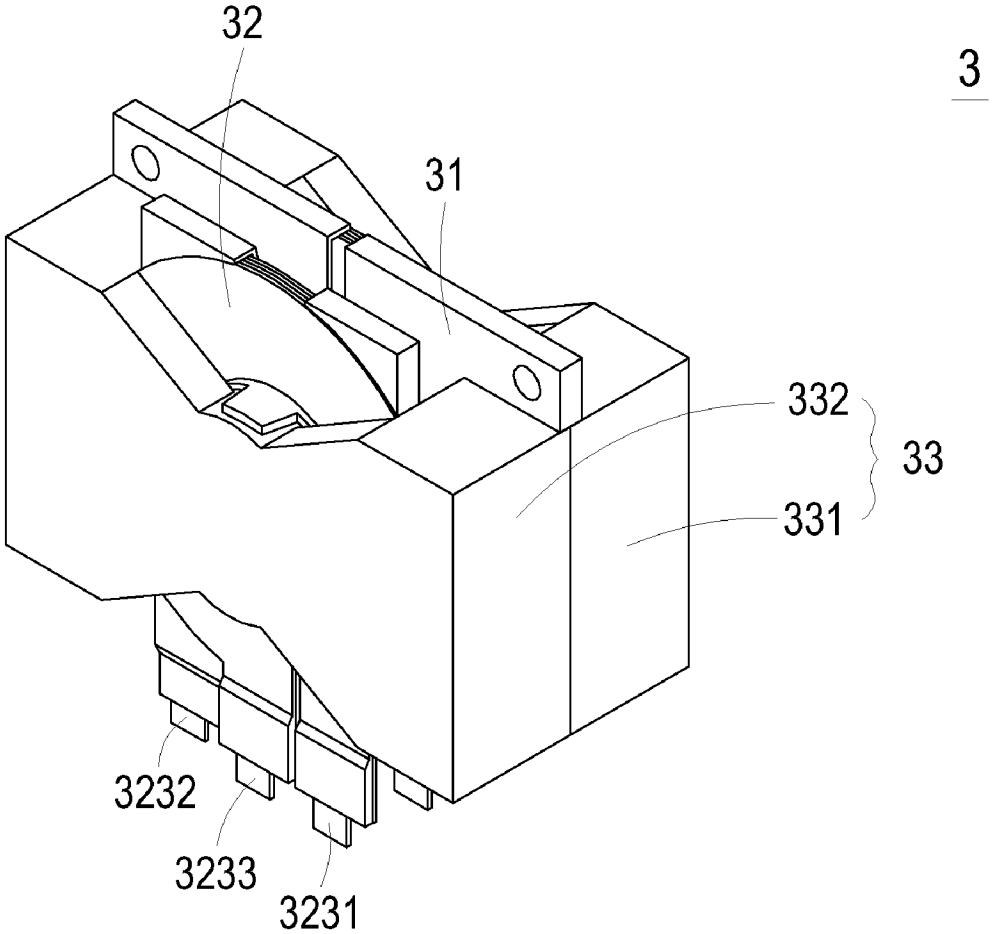
FIG. 5B is a schematic assembled view of the transformer of FIG. 5A.

FIG. 5A is a schematic exploded view illustrating a transformer having a conductive winding module of FIG. 4B. FIG. 5B is a schematic assembled view of the transformer of FIG. 5A. As shown in FIGS. 5A and 5B, the transformer 3 principally includes a primary winding assembly, at least one conductive winding module 32 and a magnetic core assembly 33. In this embodiment, the conductive winding module 32 functions as a secondary winding assembly. The primary winding assembly includes a bobbin 31 and a primary winding coil (not shown). The bobbin 31 includes a winding section 311 and a channel 312. The primary winding coil is wound around the winding section 311. Alternatively, the primary winding assembly may be replaced by a specified circuit board. Such a specified circuit board is substantially a ring-shaped structure and the primary winding coil is formed as a trace pattern within the circuit board. The magnetic core assembly 33 includes a first magnetic part 331 and a second magnetic part 332. In this embodiment, the first magnetic part 331 and the second magnetic part 332 of the magnetic core assembly 33 are cooperatively formed as an EE-type core assembly. The first magnetic part 331 and the second magnetic part 332 have respective middle portions 331*a* and 332*a*.

Hereinafter, a process of assembling the transformer 3 will be illustrated with reference to FIG. 5A. First of all, two conductive winding modules 32 are arranged on bilateral sides of the bobbin 31 such that the through-holes 3218 of the conductive winding modules 32 are aligned with the channel 312 of the bobbin 31. Next, the middle portions 331*a*, 332*a* of the first magnetic part 331 and the second magnetic part 332 are partially embedded into the through-holes 3218 of the conductive winding modules 32 and the channel 312 of the bobbin 31. As a result, the primary winding assembly and the secondary winding assemblies (i.e. the conductive winding modules 32) interact with the magnetic core assembly 33 to achieve the purpose of voltage regulation. The resulting structure of the transformer is schematically shown in FIG. 5B. In this embodiment, each of the conductive winding modules 32 is an unbroken multi-loop conductive piece that has three output terminals (3231, 3232 and 3233) in a staggered arrangement. Furthermore, three output terminals may be inserted into a circuit board (not shown) such as an auxiliary circuit board or a system circuit board.

For facilitating securely assembling the transformer 3, the inner surfaces of the first magnetic part 331 and the second magnetic part 332 are bonded onto the conductive winding modules 32 via an adhesive (not shown).

In some embodiments, several conductive winding modules 32 and the magnetic core assembly 33 are directly combined as an inductor. The procedures of assembling the inductor are similar to those described in FIG. 5A, and are not redundantly described herein. As a result, the conductive winding modules 32 interact with the magnetic core assembly 33 to achieve the purpose of voltage regulation.

From the above description, the conductive winding module of the present invention may be used as the secondary winding coil of the transformer. Since the conductive winding module is an unbroken multi-loop conductive piece, the overall volume of the conductive winding module is reduced and the power loss is decreased. Since the process of assembling the conductive winding module is very simple, the transformer is suitable for mass production. Moreover, since the conductive winding module has at least three output terminals in a staggered arrangement, the applications of the magnetic element are expanded.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A conductive winding module for use in a magnetic element, said conductive winding module comprising: multiple conductive units having respective hollow portions; and multiple output terminals arranged on said conductive units, wherein said conductive units are folded with respect to a connecting line between said conductive units such that said hollow portions are aligned with each other to define a through-hole and said multiple output terminals are staggered to form at least three output terminals arranged in a staggered configuration, wherein any two of said multiple output terminals are arranged without superposed with each other and said multiple output terminals and said conductive units are perpendicular to a circuit board and wherein the entire terminal section of the multiple output terminals arranged on said conductive units are directly inserted into said circuit board.

2. The conductive winding module according to claim 1 wherein said output terminals are integrally formed with corresponding conductive units.

3. The conductive winding module according to claim 1 wherein said magnetic element further comprises a magnetic core assembly, which is partially embedded into said through-hole of said conductive winding module.

4. The conductive winding module according to claim 1 wherein said magnetic element is an inductor.

5. The conductive winding module according to claim 1 wherein said magnetic element is a transformer.

6. The conductive winding module according to claim 1 wherein the conductive winding module is an unbroken multi-loop conductive piece made of metallic material.

7. The conductive winding module according to claim 6 wherein said metallic material is copper.

8. The conductive winding module according to claim 1 wherein said conductive units are sheathed by an insulating layer but said output terminals are not sheathed by said insulating layer.

9. The conductive winding module according to claim 1 wherein at least one of said output terminals is disposed along a centerline of said hollow portion of one conductive unit.

10. The conductive winding module according to claim 1 wherein said circuit board is an auxiliary circuit board or a system circuit board.

11. A magnetic element comprising:

a conductive winding module comprising multiple conductive units and multiple output terminals, said conductive units having respective hollow portions, said multiple output terminals being arranged on said conductive units, wherein said conductive units are folded with respect to a connecting line between said conductive units such that said hollow portions are aligned with each other to define a through-hole and said multiple output terminals are staggered to form at least three output terminals arranged in a staggered configuration, wherein any two of said multiple output terminals are arranged without superposed with each other and said multiple output terminals and said conductive units are perpendicular to a circuit board and wherein the entire terminal section of the multiple output terminals arranged on said conductive units are directly inserted into said circuit board; and a magnetic core assembly partially embedded into said through-hole of said conductive winding module.

12. The magnetic element according to claim 11 wherein said output terminals are integrally formed with corresponding conductive units.

13. The magnetic element according to claim 11 wherein said magnetic element is an inductor.

14. The magnetic element according to claim 11 wherein said magnetic element is a transformer.

15. The magnetic element according to claim 11 wherein said transformer further comprises a primary winding assembly including a bobbin and a primary winding coil, said bobbin has a winding section and a channel, and said primary winding coil is wound around said winding section of said bobbin.

16. The magnetic element according to claim 11 wherein the conductive winding module is an unbroken multi-loop conductive piece made of metallic material.

17. The magnetic element according to claim 16 wherein said metallic material is copper.

18. The magnetic element according to claim 11 wherein said conductive units are sheathed by an insulating layer but said output terminals are not sheathed by said insulating layer.

19. The magnetic element according to claim 11 wherein at least one of said output terminals is disposed along a centerline of said hollow portion of one conductive unit.

20. The magnetic element according to claim 11 wherein said circuit board is an auxiliary circuit board or a system circuit board.

* * * * *